US005918479A

United States Patent [19]

Ji et al.

[11] Patent Number: 5,918,479

[45] Date of Patent: Jul. 6, 1999

[54] REFRIGERATOR WITH BLADES FOR DISPERSING COOL AIR HORIZONTALLY AND VERTICALLY

[75] Inventors: Joon Dong Ji, Suwon; Jae In Kim, Seoul, both of Rep. of Korea

[73] Assignee: Samsung Electronics Co., Ltd., Suwon, Rep. of Korea

[21] Appl. No.: 09/121,298

[22] Filed: Jul. 23, 1998

[30] Foreign Application Priority Data

Jul. 31, 1997 [KR] Rep. of Korea ..... 97-36653

[51] Int. Cl.[6] ..... F25D 17/04

[52] U.S. Cl. ..... 62/408; 62/441; 62/187

[58] Field of Search ..... 62/186, 187, 408, 62/426, 441; 236/49.3, 149.5

[56] References Cited

U.S. PATENT DOCUMENTS 4,671,078 6/1987 Pink ..... 62/408

4,738,116 4/1988 Himeno et al. ..... 62/186

5,737,935 4/1998 Heo ..... 62/408 X 5,778,694 7/1998 Jeong ..... 62/408 X

*Primary Examiner*—Henry Bennett

*Assistant Examiner*—Susanne C. Tinker

*Attorney, Agent, or Firm*—Burns, Doane, Swecker & Mathis, L.L.P.

[57] ABSTRACT

Disclosed is a refrigerator having a device for dispersing cool air in a cooling compartment. A duct having cool air discharge ports is formed in an inner wall of the compartment. In the duct are installed a horizontal-dispersing blade disposed along a vertical rotational shaft, and a vertical-dispersing blade capable of rotating with respect to a horizontal axis. A worm gear in installed on the shaft, and a worm wheel engaged with the worm gear is installed on the vertical-dispersing blade. As the shaft is rotated by a motor, the blades rotate. Thus, the cool air is uniformly dispersed in the compartment, and the temperature in the compartment is maintained uniform. The angular position of the blades are controlled independently of each other substantially, so concentrative cooling can be performed easily.

4 Claims, 7 Drawing Sheets

REFRIGERATOR WITH BLADES FOR DISPERSING COOL AIR HORIZONTALLY AND VERTICALLY

BACKGROUND OF THE INVENTION

1. Field of the Invention

The present invention relates to a refrigerator having a cabinet for forming a cooling compartment, and a duct for forming a passage of cool air, which is provided in an inner wall of the cooling compartment and has at least one cool air discharge port opened into the cooling compartment, and more particularly relates to a refrigerator having a device for dispersing cool air uniformly into the cooling compartment.

2. Prior Art

In general, a refrigerator has a cabinet for forming a pair of cooling compartments, i.e., a freezing compartment and a fresh food compartment which are partitioned by a partitioning wall, a freezing compartment door and a fresh food compartment door for opening/closing the cooling compartments respectively, and a cooling system for supplying the freezing compartment and the fresh food compartment with cool air which is comprised of a compressor, a condenser and an evaporator. The cool air generated by the evaporator flows along a supply duct formed in a rear wall of each compartment, and then is supplied into each cooling compartment by a blowing fan through cool air discharge ports opened thereinto.

In such a conventional refrigerator, however, there exist an area on which the cool air discharged through the cool air discharge ports is concentrated, and an area to which a relatively small amount of cool air is supplied, so there occurs a deviation of temperature in the cooling compartments and uniform cooling cannot be achieved. Therefore, the refrigerator adopting so called tri-dimensional cooling method which has amended such a problem has been proposed. In the refrigerator adopting the tri-dimensional cooling method, the cool air discharge ports are provided at both side walls as well as at the rear wall of the cooling compartment in order to promote the uniform cooling.

However, in such a refrigerator adopting the tri-dimensional cooling method, since the cool air is discharged through the cool air discharge ports in fixed directions, there may be a dead-zone at an edge area which is not supplied with the cool air sufficiently. In particular, since the supply duct has to be provided not only in the rear wall but also in the side walls, there are problems that the space for storing food is reduced and the manufacturing cost increases due to the increased number of components and processes.

The uniform distribution of cool air has risen to an important problem in relation to the trend to use large-sized refrigerator.

In consideration of such a problem, the applicant of this invention has proposed a refrigerator having a device for dispersing cool air in International Patent Application WO 95/27278. FIGS. 1 through 3 are a side view, a partial enlarged sectional view, and an exploded perspective view of main elements of the refrigerator having the device for dispersing cool air.

The conventional refrigerator having the device for dispersing cool air has a pair of cooling compartments 2 and 3 in a cabinet 1, which are partitioned from each other by a partitioning 2 wall 5. The cooling compartments 2 and 3 are called a freezing compartment 2 of relatively low temperature and a fresh food compartment 3 of relatively high temperature. On the front opening of the cooling compartments 2 and 3, doors 6 and 7 for opening/closing them are installed respectively. In the cabinet 1 is installed a cooling system comprising a compressor 11, a condenser (not shown), a freezing compartment evaporator 12*a*, and a fresh food compartment evaporator 12*b*. The cool air generated from the evaporators 12*a* and 12*b* is supplied to the corresponding compartments 2 and 3 by a freezing compartment fan 13*a* and a fresh food compartment fan 13*b* respectively.

A duct plate 9 of partial cylinder shape having cool air discharge ports 16 opened to the fresh food compartment 3 is attached to an inner wall plate 23 forming a rear inner wall surface of the fresh food compartment 3, and a supply duct 15 and a return duct 17 separated from each other by a seal plate 25 are provided between the duct plate 9 and a rear wall 4 of the cabinet 1. In the supply duct 15 is installed a duct member 21 for guiding the cool air blown by the fresh food compartment fan 13*b* downwardly. The cool air generated by the fresh food compartment evaporator 12*b* is blown by the fresh food compartment fan 13*b*, and then supplied to the fresh food compartment 3 via the supply duct 15 and the cool air discharge ports 16.

A cool air dispersing device 130 is installed in the supply duct 15. The cool air dispersing device 130 is comprised of a rotational shaft 131 having a vertical axis, cool air dispersing blades 132 assembled with the rotational shaft 131 in correspondence with the cool air discharge ports 16 respectively, and a driving motor 135 for rotating the rotational shaft 131. Each of the cool air dispersing blades 132 is comprised of three discs 136, 137 and 138 disposed in parallel with each other along the axis direction, and a first blade part 133 and a second blade part 134 disposed between the discs 136, 137 and 138. Each of the blade parts 133 and 134 are bent so that their cross section is a lax shape of alphabet S. The blade parts 133 and 134 are bent to the opposite directions to each other.

In the refrigerator having the above-described constitution, when the driving motor 131 rotates the rotational shaft 131 at a low speed, the cool air flowing along the supply duct 15 changes its flowing direction along the bent surface of the cool air dispersing blades 132, and is discharged into the fresh food compartment 3 to be dispersed horizontally. Meanwhile, when the concentrative cooling on a specific area is needed, the driving motor 135 stops the rotational shaft 131 in accordance with the direction of the cool air dispersing blades 132 so that the cool air is concentrated on the specific area.

However, since the blade parts 133 and 134 of the cool air dispersing device 130 are bent to be shaped into the lax alphabet S, left or right side of the fresh food compartment 3 may not be supplied with the cool air sufficiently according to the rotational direction of the rotational shaft 131, and the smooth flow of cool air may be impeded by a vortex of the cool air formed about the cool air discharge ports 16.

Moreover, although such a conventional cool air dispersing device 130 can achieve the uniform distribution of the cool air horizontally, the vertical distribution of the cool air cannot be uniform sufficiently, so there is a limitation in realizing the uniform cooling through the overall area of the fresh food compartment 3. Therefore, a temperature difference may occur between the upper area and the lower area of the fresh food compartment 3.

Furthermore, the construction of the cool air dispersing device 130 is complex, so the manufacturing and assembling process is not simple.

SUMMARY OF THE INVENTION

The present invention has been proposed to overcome the above-described problems in the prior art, and accordingly it is the object of the present invention to provide a refrigerator having a cool air dispersing device, which does not generate a vortex of cool air, can disperse the cool air horizontally and vertically, and has a simple construction.

To achieve the above object, the present invention provides a refrigerator having a cooling compartment for storing food, and a duct being provided in a side wall of said cooling compartment, said duct for forming a cool air passage, said duct having at least one cool air discharge port opened into said cooling compartment, said refrigerator comprising: a horizontal-dispersing blade being disposed near the discharge port in said duct, said horizontal-dispersing blade being disposed along a vertical axis; a rotational shaft being connected with said horizontal-dispersing blade, said rotational shaft being extended along the vertical axis; a means for rotating said rotational shaft; a worm gear being installed on said rotational shaft, said worm gear being rotated together with said rotational shaft; a vertical-dispersing blade being capable of rotating with respect to a horizontal axis; and a worm wheel being installed on said vertical-dispersing blade, said worm wheel being engaged with said worm gear.

Preferably, a pair of horizontal-dispersing blades correspond to each of the discharge ports, and a plurality of vertical-dispersing blades correspond to a plurality of discharge ports, respectively.

Said rotating means is a stepping motor, so the angular stop position of the rotational shaft can be controlled.

According to the present invention, a stable cool air flow and a uniform distribution of the cool air can be achieved without the vortex of the cool air about the cool air discharge ports. In particular, since the horizontal-dispersing blades and the vertical-dispersing blades are controlled independently of each other with a single motor, the concentrative cooling of a desired area can be easily performed. Moreover, there is an advantage that the manufacturing process is simple.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
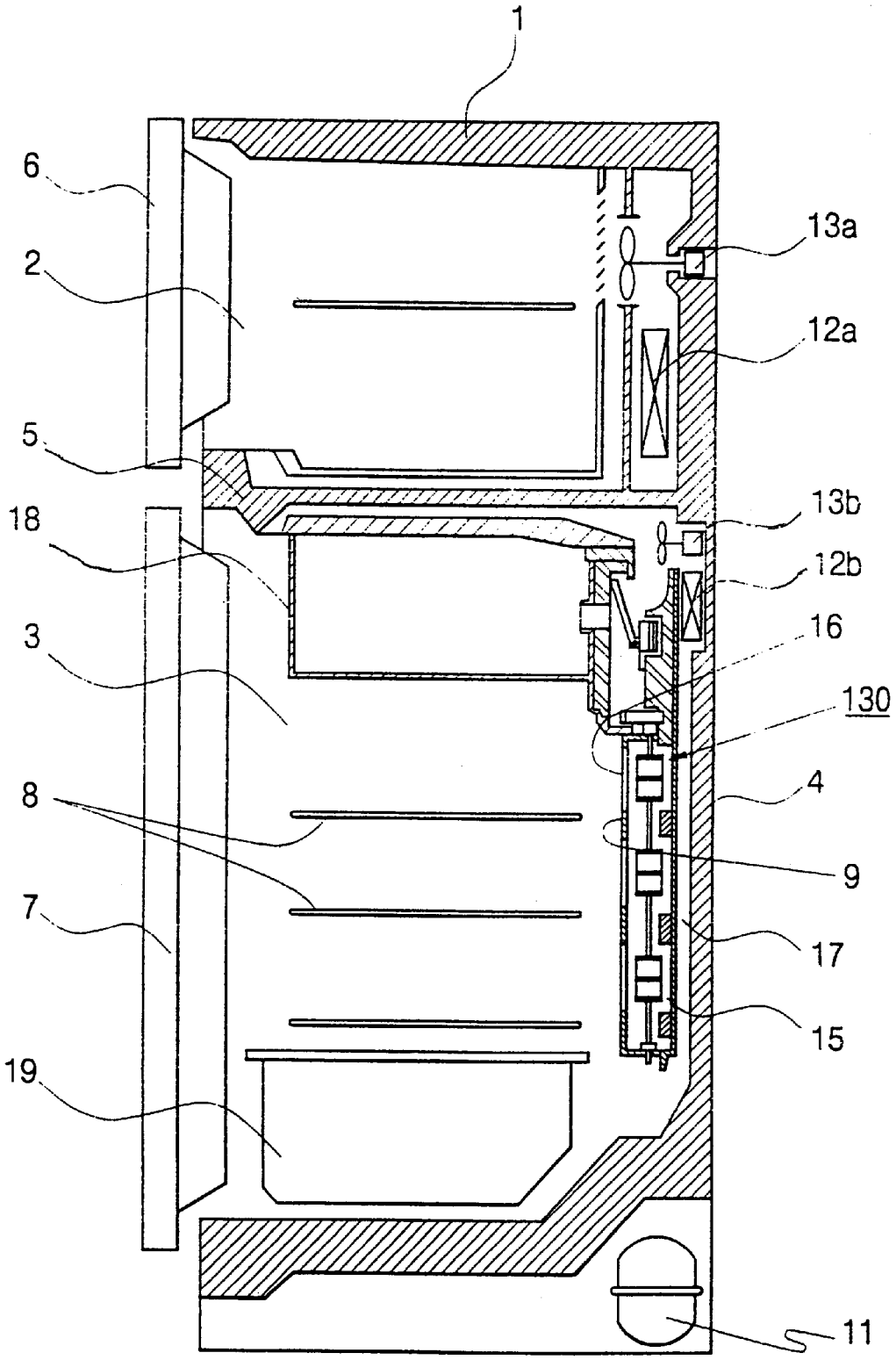
FIG. 1 (PRIOR ART)
FIG. 1 is a side sectional view of a conventional refrigerator having cool air dispersing blades.
Figure 2:
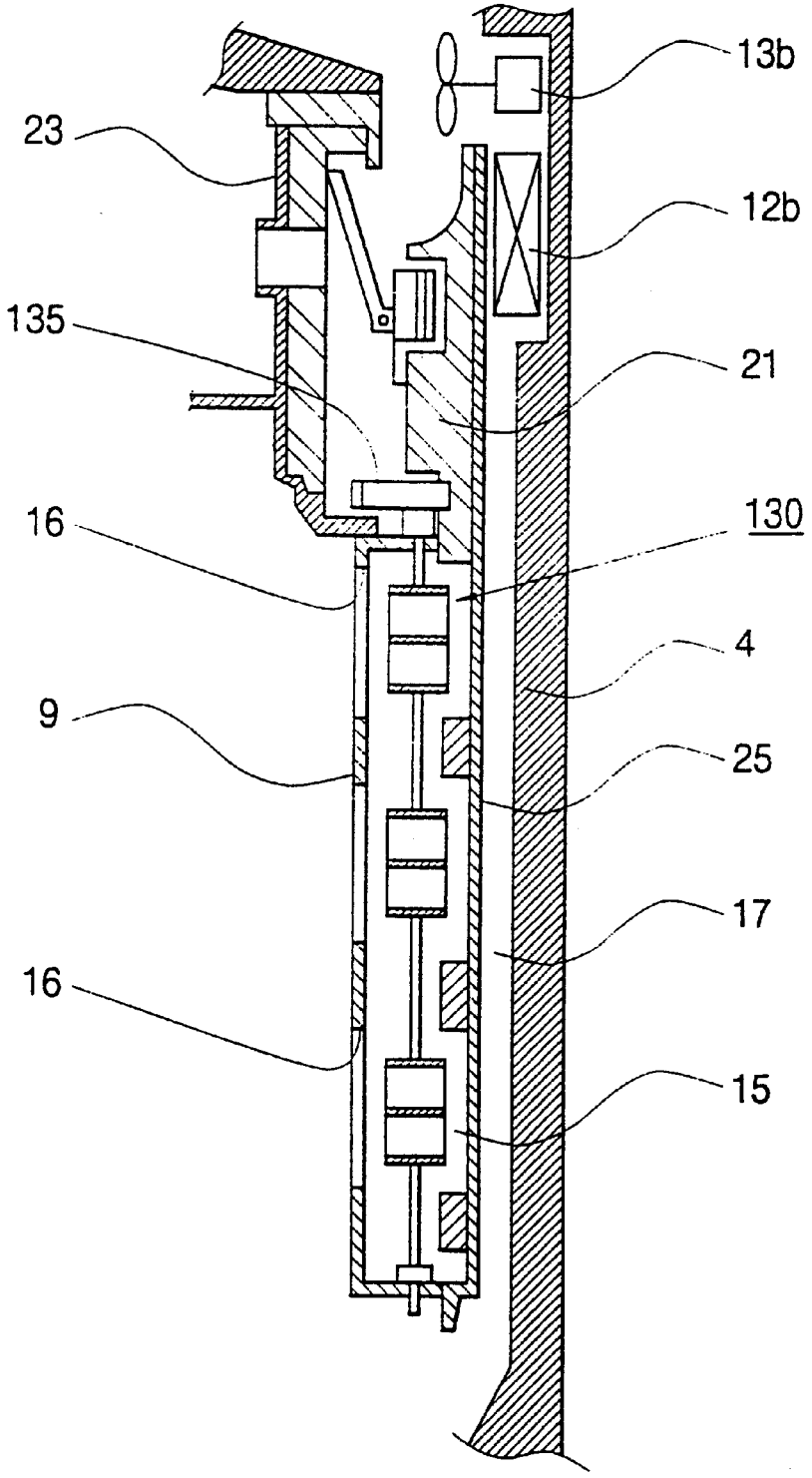
FIG. 2 (PRIOR ART)
FIG. 2 is a partial enlarged sectional view of FIG. 1.
Figure 3:
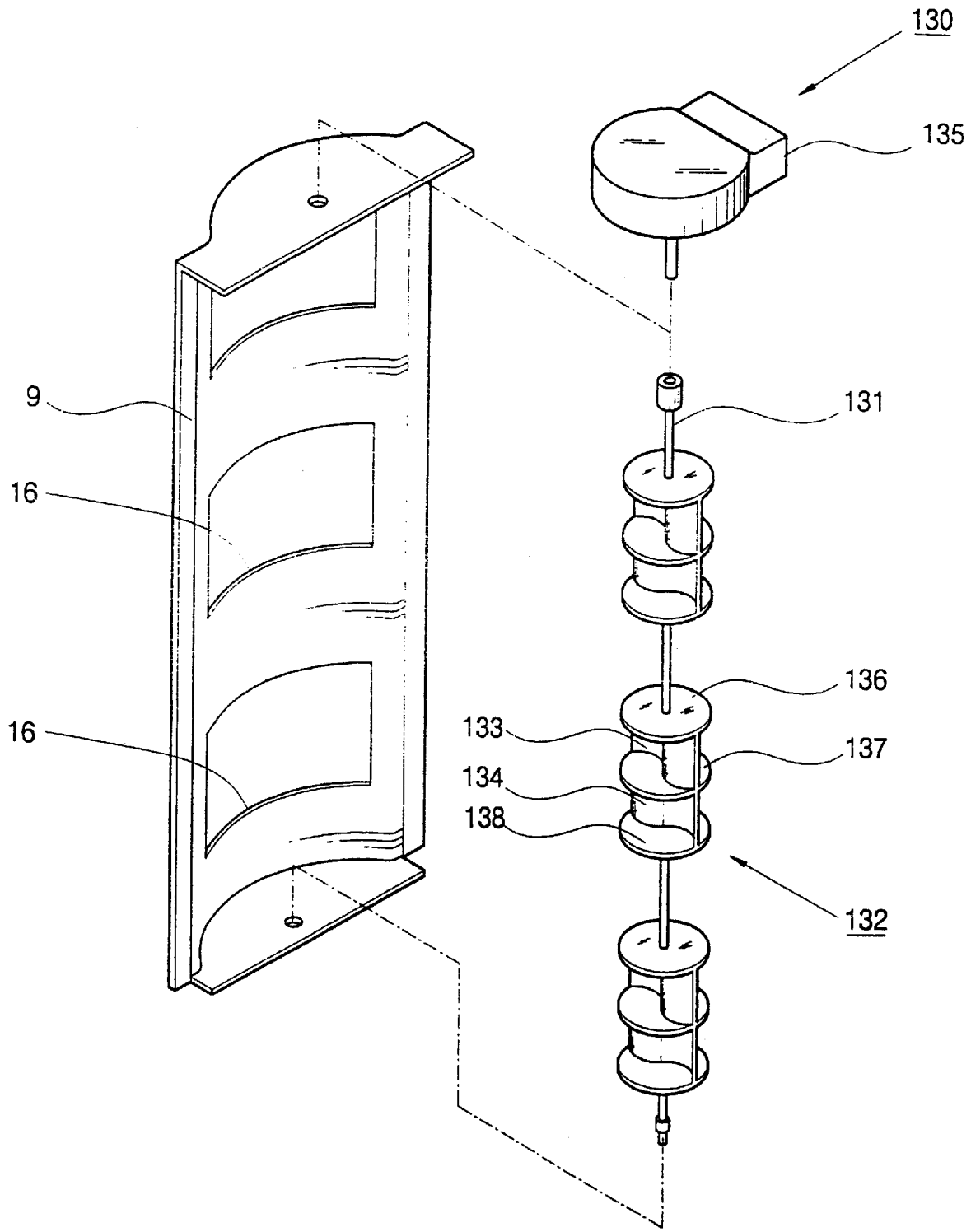
FIG. 3 (PRIOR ART)
FIG. 3 is an enlarged exploded perspective view of main elements of FIG. 2.

Hereinafter, the present invention will be described in detail with reference to the drawings. The same or similar parts with the parts shown in FIGS. 1 through 3 relating to the conventional art will be referred to with the same reference numerals. The description of the parts in each embodiment which are substantially the same with the parts of the prior art will be omitted.

Figure 4:
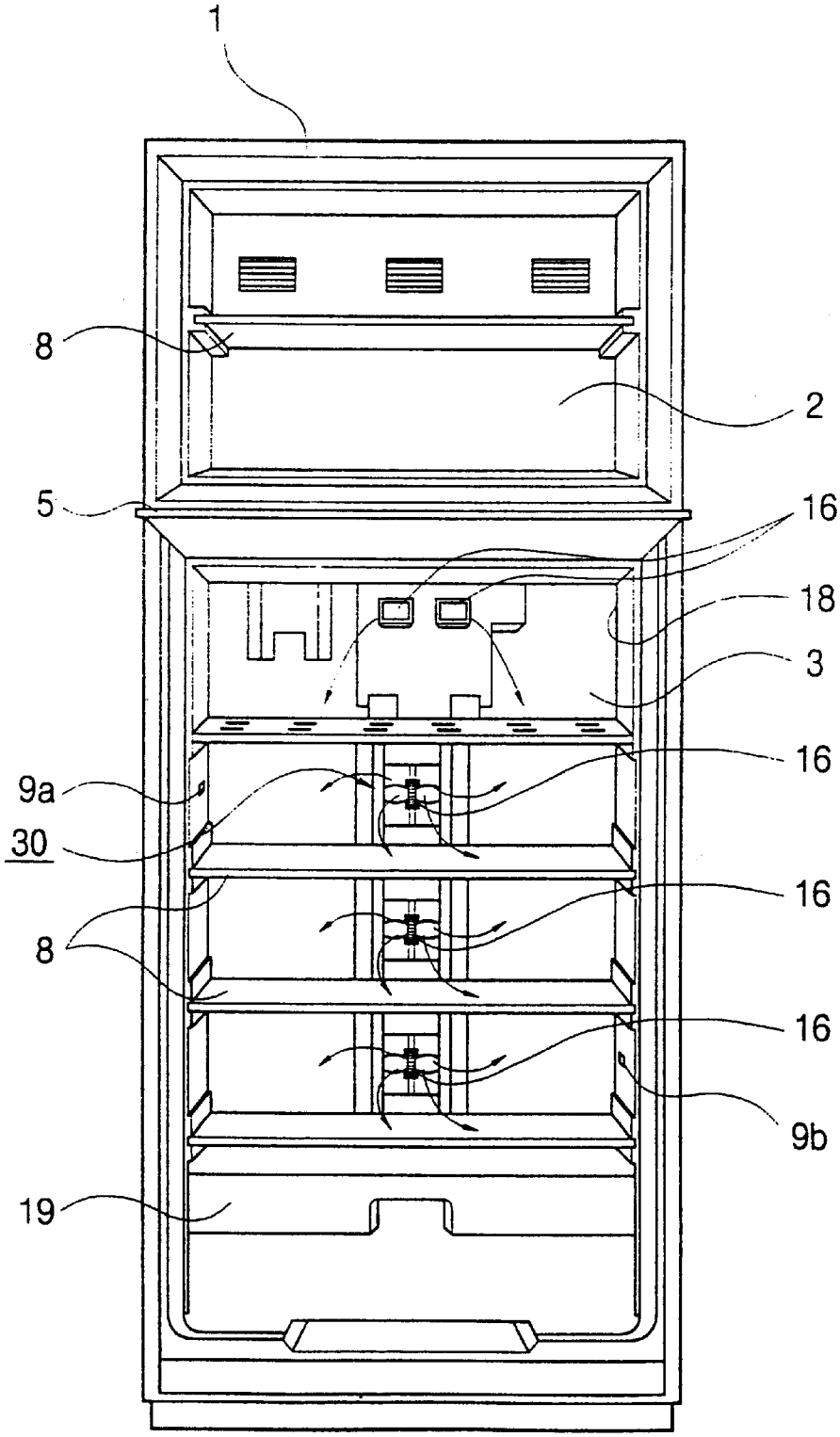
FIG. 4 is a front view of a refrigerator according to the present invention.
Figure 5:
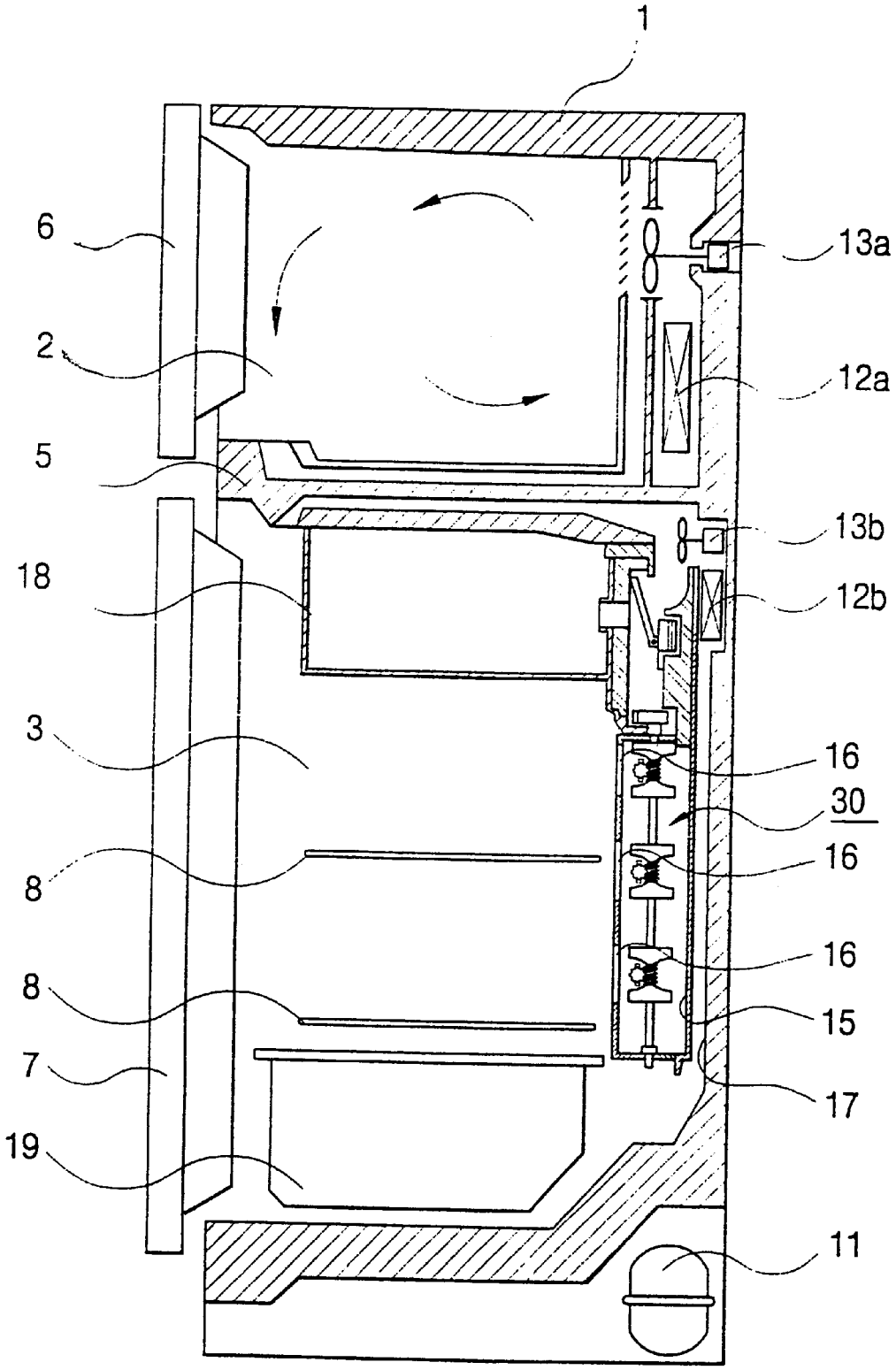
FIG. 5 is a side sectional view of FIG. 4.

FIG. 4 is a front view of a refrigerator according to the present invention, and FIG. 5 is a side sectional view of FIG. 4. The refrigerator has, as the conventional refrigerator which has been illustrated with reference to FIGS. 1 through 3, a cabinet 1 forming freezing compartment 2 and a fresh food compartment which are partitioned by a partitioning wall 5 and are disposed upper and lower parts thereof, respectively. On the front openings of the freezing compartment 2 and the fresh food compartment 3, doors 6 and 7 for opening/closing them are installed respectively. In the fresh food compartment 3, shelves 8 for placing food thereon is installed, which divide the fresh food compartment 3 into three stratified area, i. e., an upper area, a middle area, and a lower area. A special fresh chamber 18 for storing food which are proper to a specific temperature range is formed at the upper part of the fresh food compartment 3, and a vegetable chamber 19 for storing vegetables is formed at the lower part of the fresh food compartment 3.

In the cabinet 1 is installed a cooling system comprising a compressor 11, a condenser (not shown), a freezing compartment evaporator 12*a,* and a fresh food compartment evaporator 12*b*. The cool air generated by the evaporators 12*a* and 12*b* is supplied into the corresponding cooling compartments 2 and 3 by the freezing compartment fan 13*a* and the fresh food compartment fan 13*b*.

A duct plate 9 is attached on the inner wall plate 23 forming the rear inner wall of the fresh food compartment 3. The duct plate 9 is formed into a partial cylinder shape so as to protrude at the shape of an arc from the inner wall plate 23 toward the fresh food compartment 3, and has cool air discharge ports 16 opened toward the respective storing areas of the fresh food compartment 3. At the upper area of the inner wall plate 23 is provided another cool air discharge port opened toward the special fresh chamber 18.

Between the duct plate 9 and the rear wall 4 of the cabinet 1, a supply duct 15 and a return duct 17 are provided, which are partitioned from each other by a seal plate 25. In the supply duct 15, a duct member 21 for guiding the cool air blown by the fresh food compartment fan 13*b* downwardly is installed. The cool air generated by the fresh food compartment evaporator 12*b* is blown by the fresh food compartment fan 13*b* so as to be supplied into the fresh food compartment 3 via the supply duct 15 and the cool air discharge ports 16. A device 30 for dispersing the cool air is installed in the supply duct 15.

A pair of temperature sensors 9*a* and 9*b* are installed in the fresh food compartment 3. The temperature sensors 9*a* and 9*b* are installed at the upper left part and at the lower right part of the fresh food compartment 3, respectively.

Figure 6:
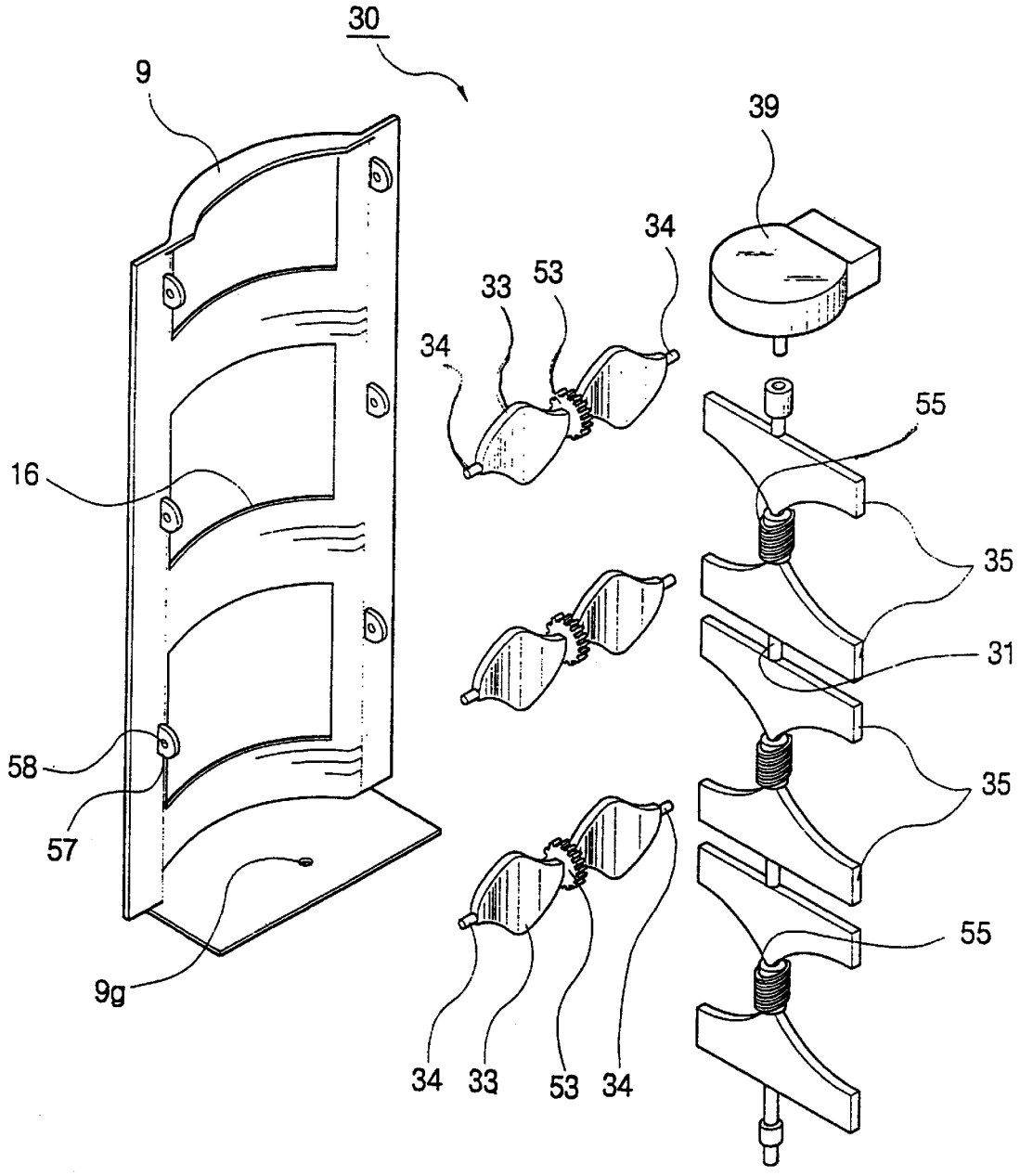
FIG. 6 is an exploded perspective of cool air dispersing device shown in FIG. 5.
Figure 7:
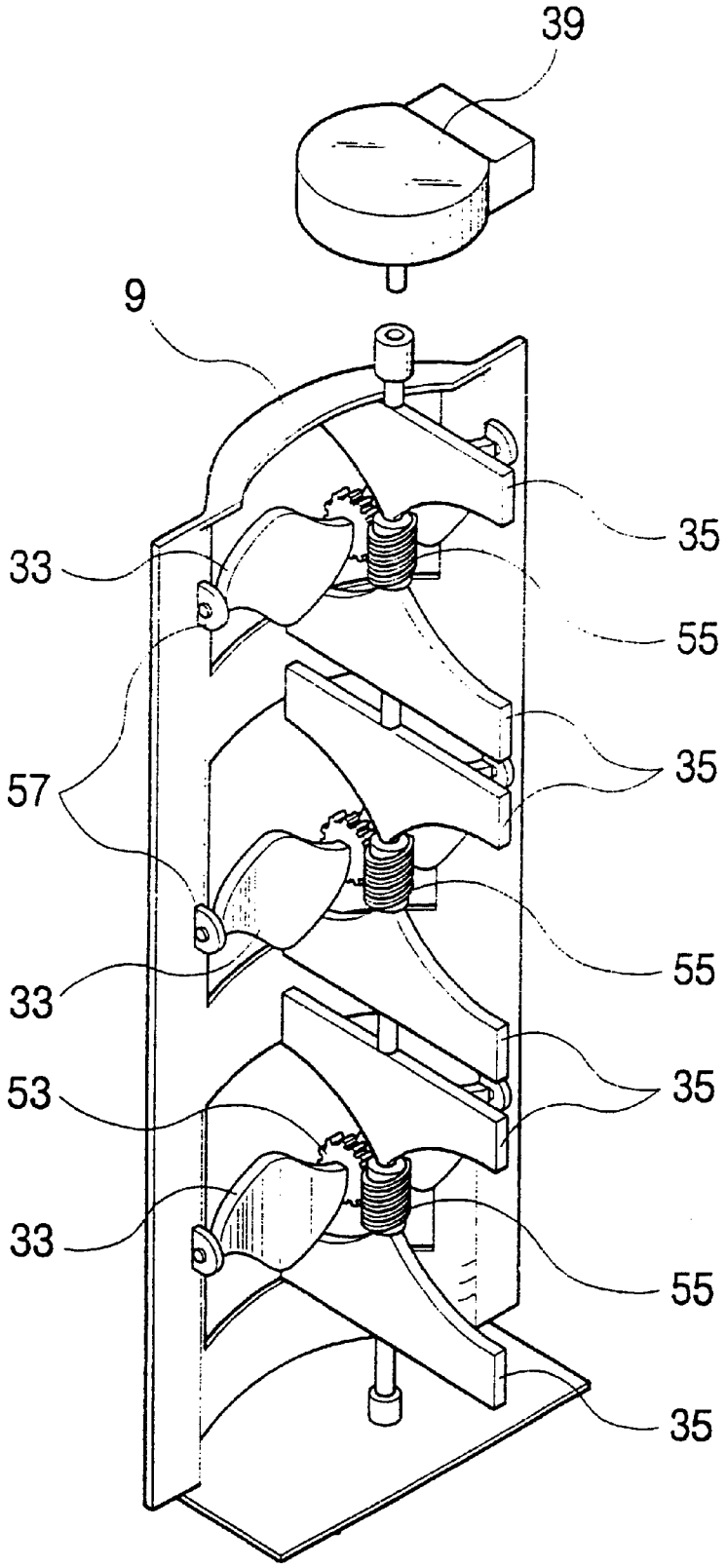
FIG. 7 is a perspective view of the assembled state of FIG. 6.

FIG. 6 is an exploded perspective of cool air dispersing device shown in FIG. 5, and FIG. 7 is a perspective view of the assembled state of FIG. 6.

The cool air dispersing device 30 has a plurality of horizontal-dispersing blades 35 disposed near the cool air discharge ports 16 in the supply duct 15. A pair of horizontal-dispersing blades 35 correspond to each of the discharge ports 16. The horizontal-dispersing blades 35 are installed on a rotational shaft 31. The upper end of the rotational shaft 31 is coupled with a driving motor 39, and the lower end of the rotational shaft 31 is inserted into a supporting port 9*g* formed at the duct plate 9. Thus, the rotational shaft 31 is supported to be capable of rotating. It is preferable that the driving motor 39 is a stepping motor capable of controlling the angular stop position thereof.

Between a pair of horizontal-dispersing blades 35 corresponding to each of the discharge ports 16, a worm gear 55 is installed. The worm gear 55 is coaxially disposed with the rotational shaft 31, and rotates together with the rotational shaft 31.

A vertical-dispersing blade 33 is installed at each of the discharge ports 16. The vertical-dispersing blade 33 is comprised of a pair of blade parts, and has horizontal shafts 34 formed at both sides thereof.

At the rear of the duct plate 9 are provided a plurality of assembly parts 57 having assembly ports 58. The assembly parts 57 are disposed at both side of each discharge port 16. The horizontal shafts 34 of the vertical-dispersing blades 33 are inserted into the assembly ports 58 of the assembly parts 57, whereby the vertical-dispersing blades 33 are supported to be capable of rotating at an area adjacent to the discharge ports 16.

A worm wheel 53 is installed between two blade parts of the vertical-dispersing blade 33. The worm wheel 53 is coaxially disposed with the horizontal shaft 34 of the vertical-dispersing blade 33. Preferably, the worm wheel 53 is formed in a body with the vertical-dispersing blade 33. The worm wheel 53 is engaged with the worm gear 55, whereby the vertical-dispersing blade 33 rotates while the rotational shaft 31 rotates.

Hereinbelow, the operation of the cool air dispersing device 30 according to the present invention will be described.

The driving motor 39 is controlled by a microprocessor which is not shown, so as to rotate the rotational shaft 31. As the rotational shaft 31 is rotated continuously, the angular position of the horizontal-dispersing blades 35 is changed continuously. Therefore, the cool air discharged through the discharge ports 16 is dispersed horizontally.

While the rotational shaft 31 is rotating, the vertical-dispersing blades 33 are rotated by the worm gears 55 and the worm wheels 53. Therefore, the cool air discharged through the discharge ports 16 is dispersed vertically. Since the cool air is dispersed horizontally and vertically by the horizontal-dispersing blades 35 and the vertical-dispersing blades 33, the cool air is dispersed into the fresh food compartment 3 uniformly.

Furthermore, if a temperature of a specific area in the fresh food compartment 3 rises suddenly, concentrative cooling can be realized by controlling the angular positions of the horizontal-dispersing blades 35 and the vertical-dispersing blades 33. That is, when a rise of temperature is sensed by the temperature sensors 9*a* and 9*b*, the microprocessor controls the angular positions of the horizontal-dispersing blades 35 and the vertical-dispersing blades 33, and stops the operation of the driving motor 39 at the controlled angular positions. Then, the cool air is concentrated on the specific area of which temperature has risen, and the temperature of the fresh food compartment 3 is maintained uniform.

According to the present invention, the vertical-dispersing blades 33 are operated along with the horizontal-dispersing blades 35, however they can be controlled independently of each other, substantially. For example, in order to concentrate the cool air on the upper right area, the rotational shaft 31 is rotated by several turns so that the vertical-dispersing blades 33 are directed upward. Then, the rotational shaft 31 is rotated a little and then stopped so that the horizontal-dispersing blades 35 are directed to the right. Then, the cool air is discharged to the upper right area.

In such a situation, since the vertical-dispersing blades 33 and the horizontal-dispersing blades 35 are connected with each other by the worm gears 55 and the worm wheels 33, the ratio of rotational angle between the horizontal-dispersing blades 35 and the vertical-dispersing blades 33 is great. Accordingly, even though the angular position of the horizontal-dispersing blades 35 is controlled after the angular position of the vertical-dispersing blades 33 is controlled as described above, the angular position of the vertical-dispersing blades 33 is not changed substantially. Thus, they can be controlled independently of each other without an additional device for driving the vertical-dispersing blades 33. Therefore, the cool air can be concentrated on a desired area with a single motor 39.

Furthermore, according to the present invention, since the horizontal-dispersing blades 35 and the vertical-dispersing blades 33 are planar plates, the vortex of cool air is not generated. Therefore, the cool air is smoothly supplied into the fresh food compartment 3.

Furthermore, according to the present invention, the device for driving the horizontal-dispersing blades 35 and the vertical-dispersing blades 33 is very simple. Thus, it is easy to manufacture the refrigerator, and durability thereof becomes great.

As described above, according to the present invention, a stable cool air flow and a uniform distribution of the cool air can be achieved without the vortex of the cool air about the cool air discharge ports. In particular, since the horizontal-dispersing blades and the vertical-dispersing blades are controlled independently of each other with a single motor, the concentrative cooling of a desired area can be easily performed. Moreover, there is an advantage that the manufacturing process is simple.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A refrigerator having a cooling compartment for storing food, and a duct being provided in a side wall of said cooling compartment, said duct for forming a cool air passage, said duct having at least one cool air discharge port opened into said cooling compartment, said refrigerator comprising:

a horizontal-dispersing blade being disposed near the discharge port in said duct, said horizontal-dispersing blade being disposed along a vertical axis;

a rotational shaft being connected with said horizontal-dispersing blade, said rotational shaft being extended along the vertical axis;

a means for rotating said rotational shaft;

a worm gear being installed on said rotational shaft, said warm gear being rotated together with said rotational shaft;

a vertical-dispersing blade being capable of rotating with respect to a horizontal axis; and a worm wheel being installed on said vertical-dispersing blade, said warm wheel being engaged with said warm gear.

2. The refrigerator as claimed in claim 1, wherein a pair of horizontal-dispersing blades correspond to each of the discharge ports.

3. The refrigerator as claimed in claim 1, wherein a plurality of vertical-dispersing blades correspond to a plurality of discharge ports, respectively.

4. The refrigerator as claimed in claim 3, wherein said rotating means is a stepping motor.

* * * * *